US009073715B2

(12) United States Patent
Yokoi

(10) Patent No.: US 9,073,715 B2
(45) Date of Patent: Jul. 7, 2015

(54) SHEET FEEDING MECHANISM AND RECORDING APPARATUS HAVING THE SHEET FEEDING MECHANISM

(71) Applicant: CANON KABUSHIKI KAISHA, Tokyo (JP)

(72) Inventor: Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/015,689

(22) Filed: Aug. 30, 2013

(65) Prior Publication Data

US 2014/0061996 A1 Mar. 6, 2014

(30) Foreign Application Priority Data

Sep. 4, 2012 (JP) ..... 2012-194010

(51) Int. Cl.

| | |
|---|---|
| ***B65H 3/06*** | (2006.01) |
| ***B65H 7/02*** | (2006.01) |
| ***B65H 3/56*** | (2006.01) |
| ***B65H 3/66*** | (2006.01) |
| ***B65H 5/06*** | (2006.01) |

(52) U.S. Cl.

CPC ..... *B65H 3/0653* (2013.01); *B65H 7/02* (2013.01); *B65H 3/06* (2013.01); *B65H 3/0684* (2013.01); *B65H 3/56* (2013.01); *B65H 3/66* (2013.01); *B65H 5/062* (2013.01); *B65H 2301/3122* (2013.01); *B65H 2301/3124* (2013.01); *B65H 2404/6111* (2013.01); *B65H 2405/1136* (2013.01); *B65H 2405/332* (2013.01); *B65H 2801/12* (2013.01)

(58) Field of Classification Search

CPC ..... B65H 3/06; B65H 3/0661; B65H 7/02; B65H 2405/11151; B65H 2405/1136; B65H 2407/30; B65H 2601/25; B65H 2601/254

USPC ..... 271/109, 37, 117, 118

See application file for complete search history.

(56) References Cited

U.S. PATENT DOCUMENTS 7,692,825 B2 * 4/2010 Koga et al. ..... 358/496

FOREIGN PATENT DOCUMENTS

| | | |
|---|---|---|
| JP | 2006-225151 A | 8/2006 |
| JP | 2011-63369 A | 3/2011 |

* cited by examiner

*Primary Examiner* — David H Bollinger

(74) *Attorney, Agent, or Firm* — Canon U.S.A., Inc. IP Division

(57) ABSTRACT

A sheet feeding mechanism includes a sheet feeding roller configured to feed an uppermost recording medium from stacked recording mediums, an inclined portion located at a downstream position of the sheet feeding roller in a conveyance direction of the recording medium and having a surface inclined with respect to the conveyance direction, and a restriction member configured not to contact the recording medium before the sheet feeding roller feeds the recording medium, and configured to contact the recording medium in a state where the recording medium is fed by the sheet feeding roller and conveyed along the inclined portion.

22 Claims, 8 Drawing Sheets

SHEET FEEDING MECHANISM AND RECORDING APPARATUS HAVING THE SHEET FEEDING MECHANISM

BACKGROUND OF THE INVENTION

1. Field of the Invention

The present invention relates to a sheet feeding mechanism for feeding a sheet-type recording medium, and a recording apparatus having the sheet feeding mechanism.

2. Description of the Related Art

In various types of recording apparatuses, as an example of structures of sheet feeding mechanisms for feeding a stacked sheet recording medium, a mechanism of an inclined surface separation system is known. In this system, the uppermost recording medium in horizontally stacked recording mediums in a sheet cassette is fed with a sheet feeding roller, and the uppermost recording medium is separated from the lower recording medium using an inclined surface provided at the downstream side of the conveyance direction to feed the mediums one by one.

In such a sheet feeding method, for example, a structure is discussed in Japanese Patent Application Laid-Open No. 2006-225151. This structure has been made by focusing attention on the point that recording mediums stacked at an upper part may slide out of a sheet cassette due to the force to attach the sheet cassette, in which the recording medium is stacked, to the recording apparatus. In this structure, a contact member for contacting the upper surface of the recording medium to prevent the movement of the recording medium is provided in a fixed manner on a sheet cassette attachment path at the recording apparatus side.

In another structure, a structure is discussed in Japanese Patent Application Laid-Open No. 2011-63369. Japanese Patent Application Laid-Open No. 2011-63369 discusses a structure for solving a problem that, in a sheet feeding operation with a sheet feeding roller, the feeding orientation of a recording medium to be fed from recording mediums stacked on a sheet feeding cassette is displaced, and the recording medium is fed in the skewed state. In this structure, a second roller is provided at the upstream side of the sheet feeding roller with respect to the sheet feeding direction to control the orientation of the recording medium, which is likely to be deformed, from above the recording medium to stabilize the orientation of the recording medium to be fed in the sheet cassette.

In Japanese Patent Application Laid-Open No. 2011-63369, with reference to FIG. 7 in the publication, a structure having a plurality of driven rollers provided to an arm including a feeding roller is also discussed. In this structure, the sheet feeding roller and the driven rollers contact the recording medium to press the recording medium to reduce a conveyance difference between the right and left sides in the width direction of the recording medium being fed by the sheet feeding roller at the downstream side in the sheet feeding direction. This structure prevents the recording medium fed from the sheet cassette from being inclined and fed (i.e., skewed).

Meanwhile, in the inclined surface separation system, for example, as illustrated in FIGS. 7 and 8, a recording medium 108 to be fed with a sheet feeding roller 110 contacts an inclined part 111 and the recording medium 108 is curved upward and conveyed. In such a state, in a portion 108m near the curving portion of the recording medium 108 and on the conveyance extended line of the sheet feeding roller 110, portions where the recording medium is bent may exist. In such a case, as indicated by the arrows, at portions 108s at the both ends of the recording medium 110 at the leading edge side in the conveyance direction, the recording medium 110 is deformed toward the center side of the recording medium.

In other words, when the sheet feeding roller 110 rotates while pressing a center portion 108C of the uppermost recording medium 108 stacked on a stacking portion 106, the uppermost recording medium 108 is conveyed in the conveyance direction. Then, the uppermost recording medium 108 is bent around the portion 108m of the recording medium 108 as the recording medium 108 advances upward along the inclined portion 111. In this state, depending on effects of the pressure of the sheet feeding roller 110, the bent posture (see the portion 108m in FIGS. 7 and 8) near the center portion of the recording medium 108 differs from the bent posture (see the portions 108s in FIGS. 7 and 8) at the both end portions of the recording medium 108. Specifically, the vicinity of the center portion of the recording medium 108 is bent at a position closer to the inclined portion 111 than the both end portions of the recording medium 108 is. Due to the differences in the bent postures in one recording medium 108, as illustrated in FIG. 8, distortion is generated at the leading edge portion of the recording medium 108.

Generally, the distortion disappears due to the stiffness of the recording medium as the sheet feeding proceeds and as an area (area of the recording medium contacting the inclined surface) of the recording medium having arrived at the inclined surface increases.

In the state the distortion exists, if the leading edge of the recording medium 108 is held in the nip formed by a rubber portion of a conveyance roller 112 and a pinch roller 113, wrinkles are formed in the recording medium 108.

Such a phenomenon is especially likely to occur in a recording medium having low stiffness such as thin paper.

To regulate such deformed conveyance of the recording medium, the structure discussed in FIG. 7 in Japanese Patent Application Laid-Open No. 2011-63369 may be employed. The structure is, however, directed to prevention of the recording medium from being fed in an inclined state, and the driven roller always contacts the recording medium with a regulating force (urging force) for regulating the recording medium from being inclined in the sheet feeding operation. As a result, a large load is applied to the driving force for sheet feeding. Further, while the structure is effective to reduce the skew, the strong pressure by the driven roller on the recording medium may cause occurrence of a bending portion like 108m illustrated in FIG. 8 also in the driven roller portion.

Further, the contact member discussed in Japanese Patent Application Laid-Open No. 2006-225151 is not configured to control distortion in a recording medium to be fed, and the contact member is fixed to the apparatus. As a result, depending on the number of stacked sheets of the recording medium, its functions are limited. Consequently, this structure is not effective to the problems to be solved in the present invention at all.

SUMMARY OF THE INVENTION

The present invention is directed to a sheet feeding apparatus capable of reducing distortion in a recording medium in curving the recording medium fed by a sheet feeding roller along an inclined surface for separation without affecting driving force for the sheet feeding, and a recording apparatus having the sheet feeding apparatus.

According to an aspect of the present invention, a sheet feeding mechanism includes a sheet feeding roller configured to feed an uppermost recording medium from stacked recording mediums, an inclined portion located at a downstream position of the sheet feeding roller in a conveyance direction of the recording medium and having a surface inclined with respect to the conveyance direction, and a restriction member configured not to contact the recording medium before the sheet feeding roller feeds the recording medium, and configured to contact the recording medium in a state where the recording medium is fed by the sheet feeding roller and conveyed along the inclined portion.

According to another aspect of the present invention, a sheet feeding mechanism includes a sheet feeding roller configured to feed stacked sheet-type recording mediums one by one from an uppermost recording medium, with an inclined portion, and a restriction member configured not to contact the recording medium before the sheet feeding roller feeds the recording medium, and configured to contact the recording medium in a state where the recording medium is curved and fed along the inclined portion.

According to yet another aspect of the present invention, a sheet feeding mechanism includes a sheet feeding roller configured to feed stacked sheet-type recording mediums one by one from an uppermost recording medium, with an inclined portion, and a restriction member configured not to contact the recording medium before the sheet feeding roller feeds the recording medium, and provided so that a leading portion of the restriction member is to be located, after the sheet feeding roller starts to feed the recording medium, at a position closer to the inclined portion by crossing a locus of the recording medium being conveyed in a state where the recording medium curves along the inclined portion.

According to exemplary embodiments of the present invention, a restriction member is provided to reduce distortion generation in a recording medium without giving a specific sheet feeding load in a sheet feeding roller feeding the recording medium by starting contact in a state where the recording medium arrives at an inclined surface and starts to curve. By the structure, feeding a recording medium can be restricted without distortion.

Further features of the present invention will become apparent from the following description of exemplary embodiments with reference to the attached drawings.

BRIEF DESCRIPTION OF THE DRAWINGS

FIG. 3A is a cross-sectional view schematically illustrating an orientation of the restriction member in a case where a small amount of recording medium is stacked. FIG. 3B is a cross-sectional view schematically illustrating an orientation of the restriction member in a case where a large amount of recording medium is stacked.

FIG. 4A illustrates a recording medium to be fed. FIG. 4B illustrates the recording medium arriving at an inclined surface after the start of the sheet feeding. FIG. 4C illustrates a state where the leading edge of the recording medium contacts a conveyance roller. FIG. 4D illustrates a state conveyance of the recording medium is started by the conveyance roller.

DESCRIPTION OF THE EMBODIMENTS

In this specification, for convenience, the expression "recording" is used to express things rendered using ink, or the like on the surface of a recording medium or things to be rendered.

Figure 1:
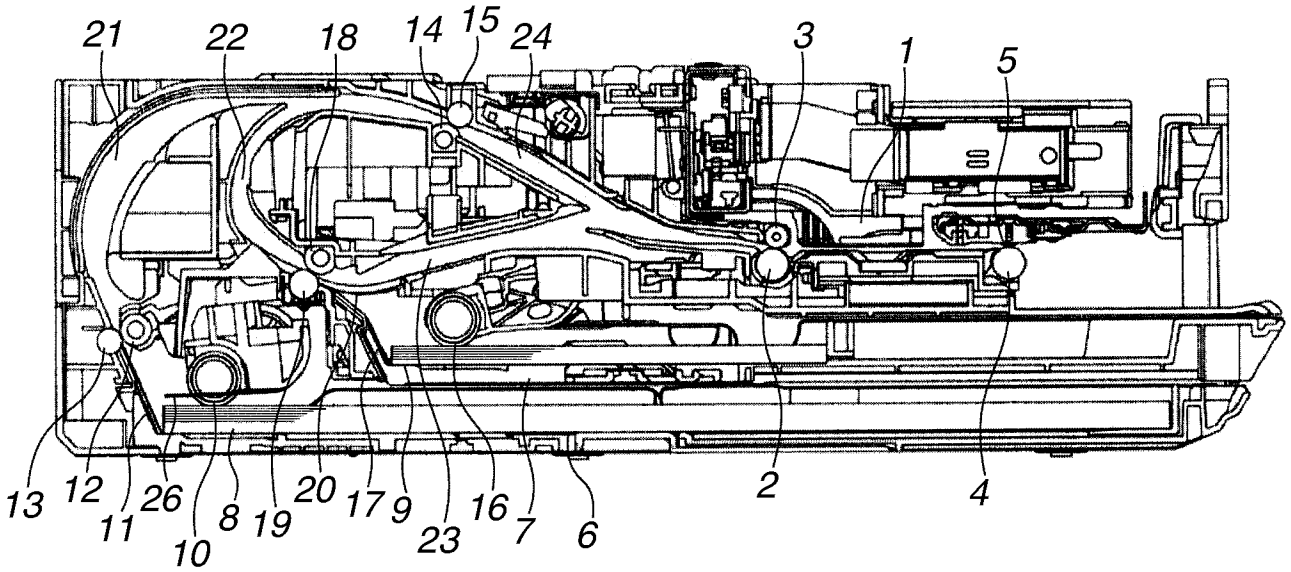
FIG. 1 is a cross-sectional view schematically illustrating a part of a recording apparatus according to a first exemplary embodiment of the present invention.

Hereinafter, a first exemplary embodiment will be described. FIG. 1 is a cross-sectional view illustrating a part of a recording apparatus according to the first exemplary embodiment of the present invention.

The recording apparatus illustrated in FIG. 1 includes a recording head 1 for discharging ink on a sheet-type recording medium for recording. At the upstream position of the recording head 1 in the conveyance direction of the recording medium, a main conveyance roller 2 and a main conveyance pinch roller 3 are provided. The recording medium is conveyed to the recording head 1 by rotation of the main conveyance roller 2 and the main conveyance pinch roller 3 in a state where the recording medium is being held between the main conveyance roller 2 and the main conveyance pinch roller 3.

At the downstream position of the recording head 1 in the conveyance direction of the recording medium, a discharge roller 4 and a driven roller 5 are provided. Between the discharge roller 4 and the driven roller 5, the recording medium on which recording has been performed by the recording head 1 is held, and the recording medium is discharged with rotation of the discharge roller 4 and the driven roller 5.

The recording apparatus according to the present exemplary embodiment includes two portions for storing the recording medium. One of the portions is disposed at the bottom surface side of the recording apparatus, and the portion is a first stacking portion 6 to which a first sheet cassette for storing a first recording medium 8 is to be attached. The other one is a second stacking portion 7, which is disposed at an upper portion of the first stacking portion 6 and to which a second sheet cassette for storing a second recording medium 9 is to be attached.

At the leading portion of the first stacking portion 6 at the downstream side in the conveyance direction of the first recording medium 8, a first sheet feeding roller 10 is provided that contacts the first recording medium 8 when the first recording medium 8 is loaded, and that performs sheet feeding. The first sheet feeding roller 10 is driven to feed the first recording medium 8 stacked on the first stacking portion 6. At the downstream position of the first sheet feeding roller 10 in the conveyance direction of the first recording medium 8, a first inclined portion 11 is provided. The first inclined portion 11 includes a slope inclined upward with respect to the conveyance direction of the first recording medium 8. In recording mediums fed by the first sheet feeding roller 10, with the use of the slope of the first inclined portion 11, only the uppermost recording medium in the first recording medium 8 is separated from the other recording mediums, and fed. At an upper portion of the first inclined portion 11 and at the downstream in the conveyance direction of the recording medium, a first conveyance roller 12 and a first pinch roller 13 are provided. The recording medium fed upward along the slope of the first inclined portion 11 is conveyed by the first conveyance roller 12 and the first pinch roller 13. The conveyed recording medium is further conveyed to a recording area via a first conveyance guide 21 by a common conveyance roller 14 and a common pinch roller 15 provided further downstream than the first conveyance roller 12 and the first pinch roller 13 in the conveyance direction of the recording medium. The first conveyance roller 12, the first pinch roller 13, the first conveyance guide 21, the common conveyance roller 14, and the common pinch roller 15 constitute a first conveyance path.

Meanwhile, at the leading portion of the second stacking portion 7, disposed at the upper portion of the first stacking portion, at the downstream side in the conveyance direction of the second recording medium 9, a second sheet feeding roller 16 is provided that contacts the second recording medium 9 when the second recording medium 9 is loaded and that performs sheet feeding. At the downstream position of the second sheet feeding roller 16 in the conveyance direction of the second recording medium 9, a second inclined portion 17 is provided. The second inclined portion 17 includes, similarly to the first inclined portion 11, a slope inclined upward with respect to the conveyance direction of the second recording medium 9. At an upper portion of the second inclined portion 17 and at the downstream in the conveyance direction of the second recording medium, a second conveyance roller 18 and a second pinch roller 19 are provided. Between the second inclined portion 17 and the second conveyance roller 18, a movable member 20 that is opened or closed by the leading edge of the second recording medium 9 fed upward along the slope of the second inclined portion 17 is provided.

The conveyed recording medium is further conveyed to the recording area via a second conveyance guide 22 by the common conveyance roller 14 and the common pinch roller 15 provided further downstream than the second conveyance roller 18 and the second pinch roller 19 in the conveyance direction of the recording medium.

The second conveyance roller 18, the second pinch roller 19, the second conveyance guide 22, the common conveyance roller 14, and the common pinch roller 15 constitute a second conveyance path.

The first conveyance guide 21 and the conveyance guide 22 merge into one member in the middle of the paths, and, at the merging point, a conveyance guide member 24 is provided. The conveyance guide member 24 includes the common conveyance roller 14 and the common pinch roller 15, and the conveyance guide member 24 extends to the main conveyance roller 2. From the conveyance guide member 24, a conveyance guide member 23 is separately extended. The conveyance guide member 23 guides each of the recording medium to the conveyance roller 18 when the main conveyance roller 2 conveys the first recording medium 8 and the second recording medium 9 in the reverse direction separating from the recording head 1 (for example, in two-sided printing).

Figure 2:
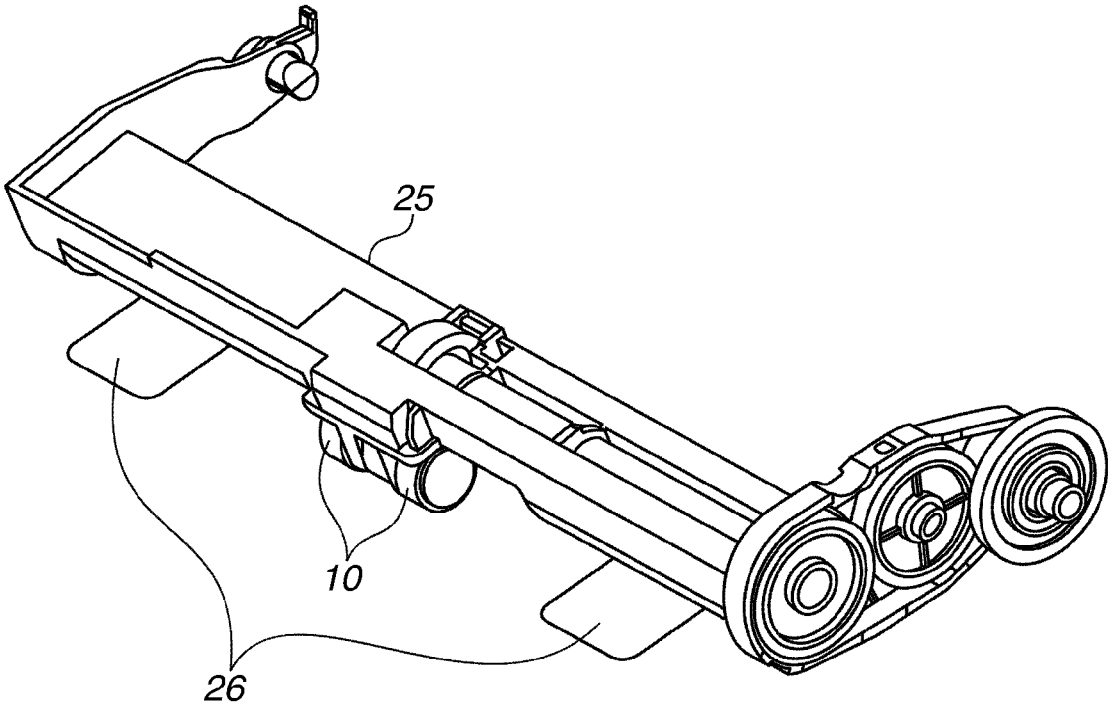
FIG. 2 is a perspective view schematically illustrating main components of a sheet feeding apparatus according to the first exemplary embodiment of the present invention.

FIG. 2 is a perspective view illustrating main components in a sheet feeding device, provided in the recording apparatus illustrated in FIG. 1, for feeding the first recording medium 8. In the following description, the sheet feeding device for feeding the first recording medium 8 is mainly described.

As illustrated in FIG. 2, the sheet feeding device according to the present exemplary embodiment includes a supporting member 25 for supporting the first sheet feeding roller 10. The supporting member 25 extends in the direction perpendicular to the conveyance direction of the first recording medium 8. The first sheet feeding roller 10 is supported at the center portion of the supporting member 25. The supporting member 25 includes a pair of restriction members 26 separately provided at the right and the left, via the first sheet feeding roller 10, in the width direction of the first recording medium 8, and supports the restriction members 26. In the present exemplary embodiment, with respect to areas near the both ends of the first recording medium 8 in the width direction, the pair of the restriction members 26 is symmetrically disposed, with the first sheet feeding roller 10 centered, such that the restriction members 26 can contact the first recording medium 8 being conveyed.

Figure 3A:
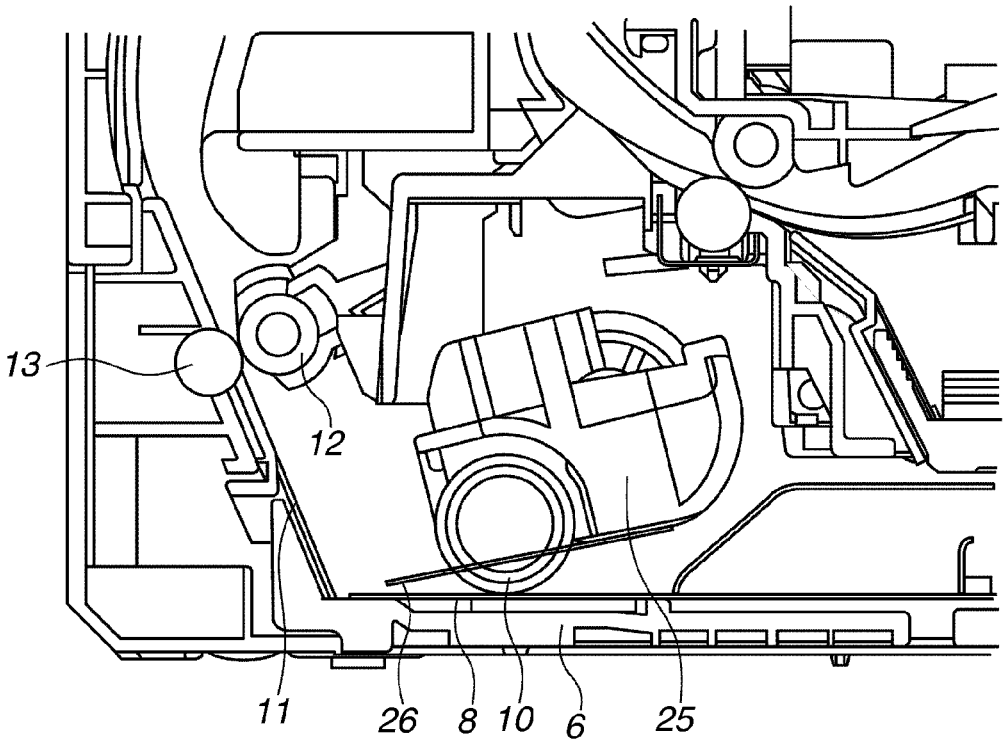
FIGS. 3A and 3B are cross-sectional views schematically illustrating orientations of a restriction member according to the first exemplary embodiment of the present invention.
Figure 3B:
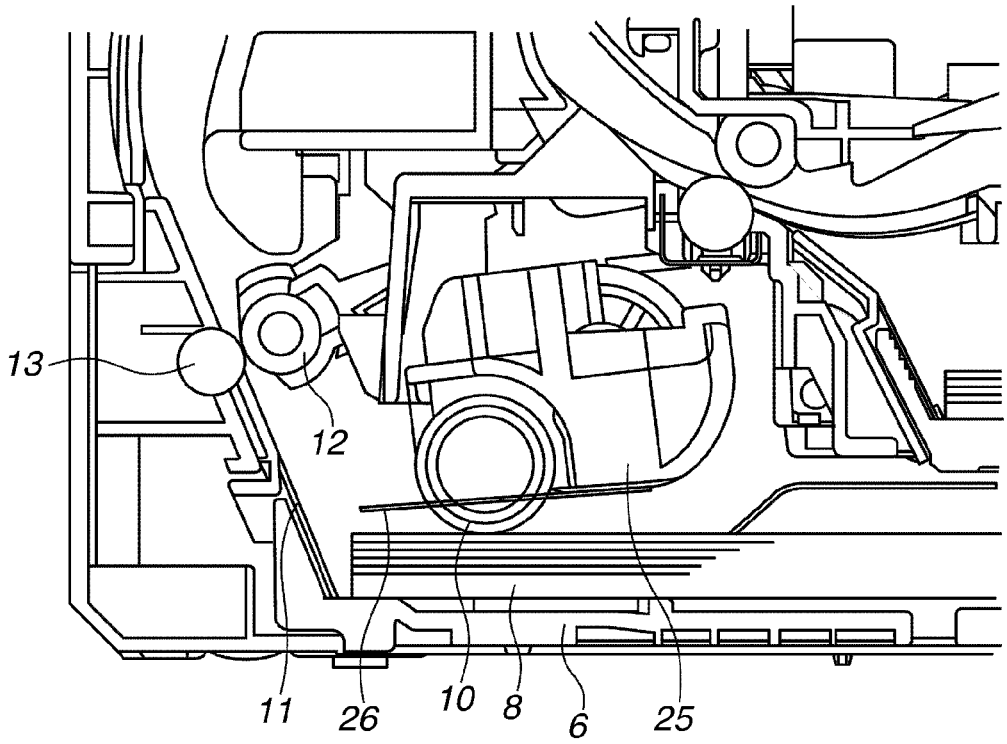

FIGS. 3A and 3B are cross-sectional views schematically illustrating states the member having the restriction members 26 illustrated in FIG. 2 is disposed in the recording apparatus. FIG. 3A illustrates a state where a small number of sheets of the first recording medium 8 is stacked on the first stacking portion 6. FIG. 3B illustrates a state where a large number of sheets of the first recording medium 8 is stacked on the first stacking portion 6.

In the present exemplary embodiment, the supporting member 25 can move up and down such that the first sheet feeding roller 10 can contact the uppermost first recording medium 8 according to the number of stacked sheets (stacked amount) of the first recording medium 8 stacked on the first stacking portion 6. By the structure, the restriction members 26 can move up and down similarly to the first sheet feeding roller 10.

Irrespective of the number of stacked sheets of the first recording medium 8 stacked on the first stacking portion 6, the leading portion of the restriction member 26 is located at a position nearer to the first inclined portion 11 than the first sheet feeding roller 10. Further, the leading portion of the restriction member 26 is located near the area where the plane of the uppermost first recording medium 8 intersects with the first inclined portion 11. Detailed description of the restriction members 26 will be made with reference to FIGS. 4A, 4B, 4C, and 4D.

Hereinafter, functions of the restriction member 26 will be described.

FIGS. 4A to 4D schematically illustrate states of the first recording medium 8 being sequentially fed.

Figure 4A:
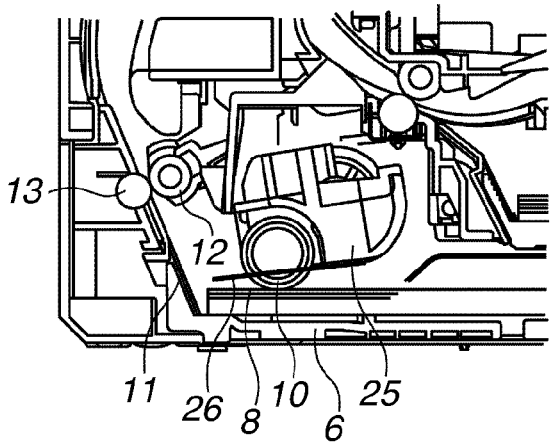
FIGS. 4A, 4B, 4C, and 4D are schematic cross-sectional views illustrating orientations of the restriction member according to the first exemplary embodiment of the present invention in a sequential manner in sheet feeding.
Figure 4B:
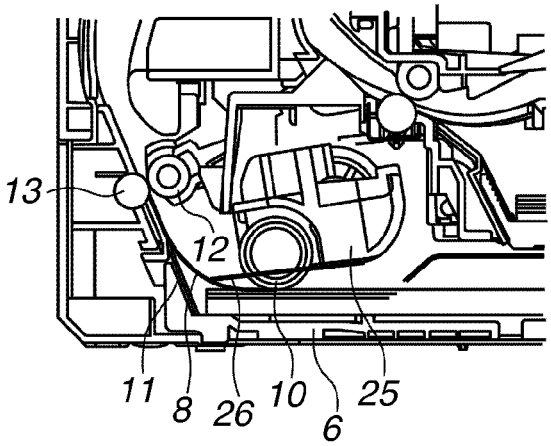
Figure 4C:
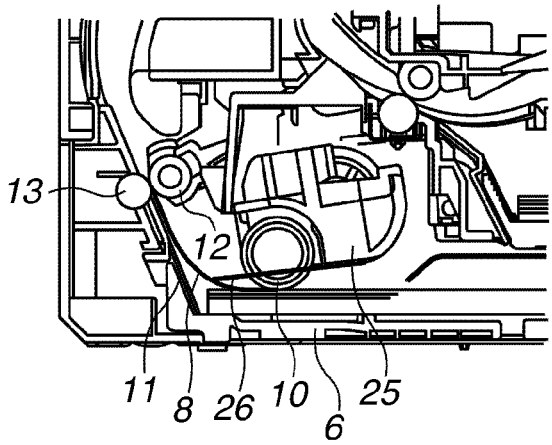
Figure 4D:
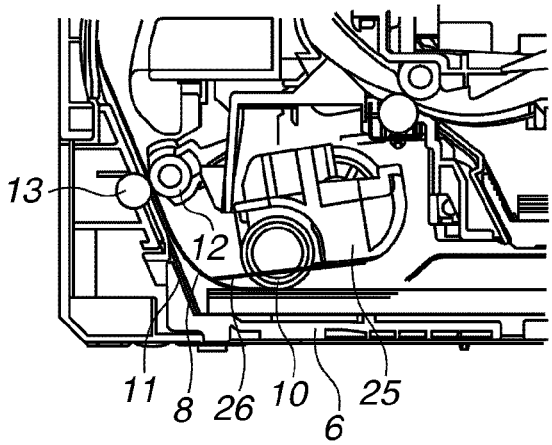

FIG. 4A illustrates the first recording medium to be fed. FIG. 4B illustrates the recording medium arriving at the inclined surface after start of the sheet feeding. FIG. 4C illustrates a state where the leading edge of the recording medium contacts the conveyance roller. FIG. 4D illustrates a state conveyance of the recording medium is started by the conveyance roller.

Before the sheet feeding of the first recording medium 8, as illustrated in FIG. 4A, FIG. 3A, or FIG. 3B, the first sheet feeding roller 10 is contacting the uppermost first recording medium 8. Meanwhile, before the sheet feeding, as illustrated in FIG. 4A, FIG. 3A, or FIG. 3B, the restriction member 26 is in a non-contact state with respect to the first recording medium 8.

As will be understood, before the sheet feeding is performed, the restriction member 26 is in a non-contact state with respect to the first recording medium 8, and, consequently, the restriction members 26 do not affect the sheet feeding load in feeding of the first recording medium 8 by the first sheet feeding roller 10.

Figure 5:
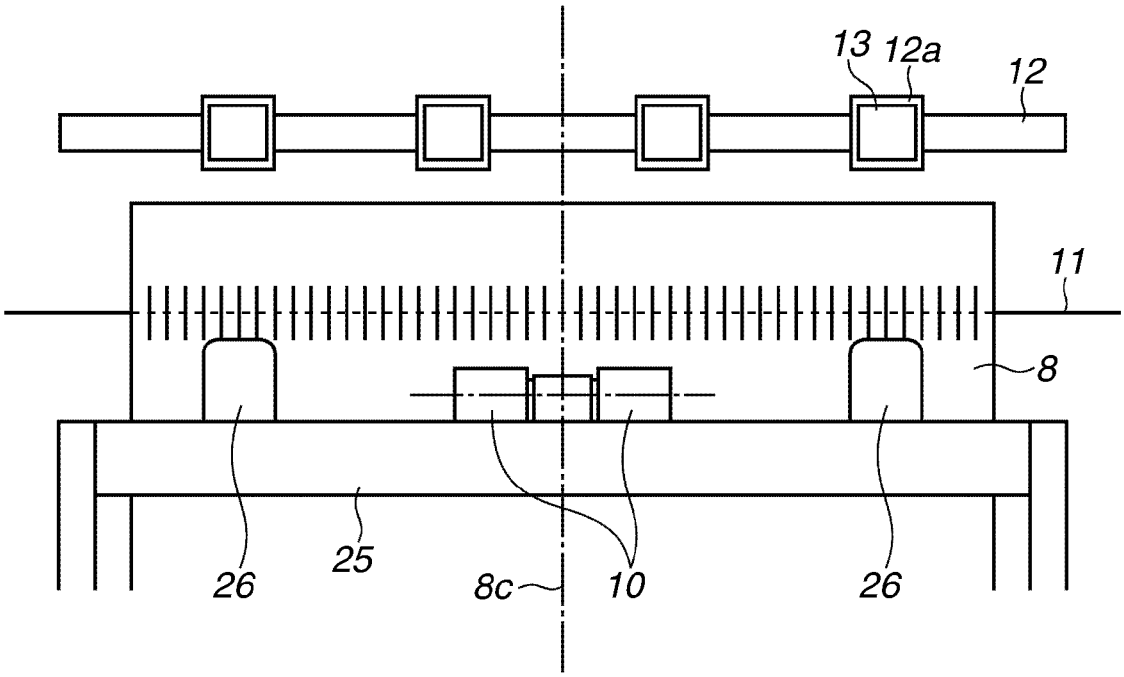
FIG. 5 is a top view schematically illustrating the sheet feeding apparatus having the restriction member according to the first exemplary embodiment of the present invention.
Figure 8:
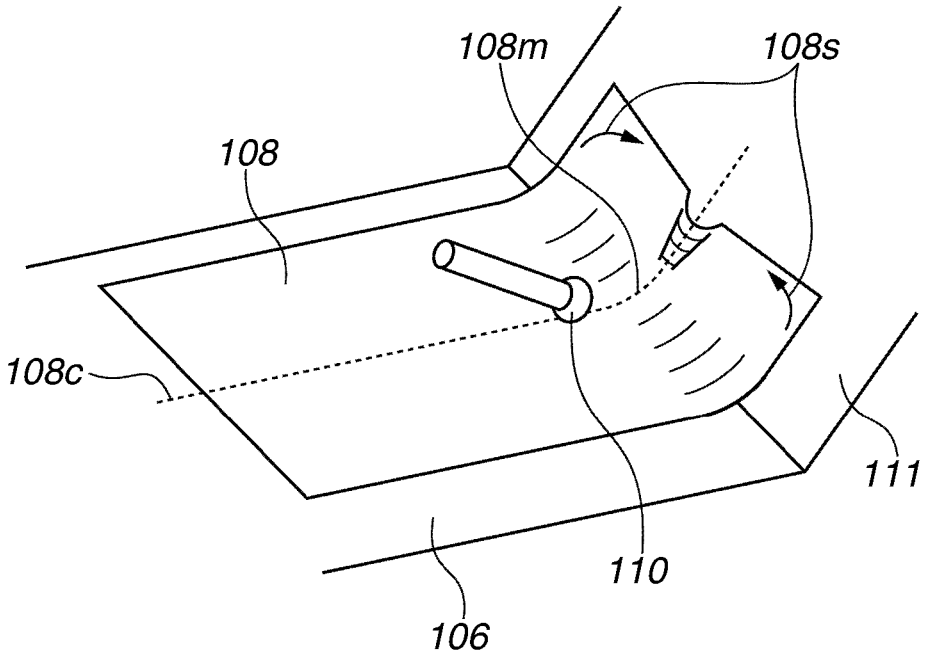
FIG. 8 is a perspective view schematically illustrating a bent posture of the recording medium 8 illustrated in FIG. 7.

Then, as illustrated in FIG. 4B, the uppermost sheet of the first recording medium 8 is fed by the first sheet feeding roller 10. The fed first recording medium 8 contacts the first inclined portion 11, and starts to curve. In the state the first recording medium 8 starts curving, the leading portion of the restriction member 26 contacts the first recording medium 8, and restricts the occurrence of distortion in the first recording medium 8 as illustrated in FIG. 8. This state is illustrated in FIG. 5. As illustrated in FIG. 5, the leading portions of the restriction members 26 contact the first recording medium 8, and thereby displacement toward the center in the areas at the both sides of the leading side of the first recording medium 8 in the width direction can be regulated. This enables the sheet feeding of the first recording medium 8 without distortion.

FIG. 4C illustrates a state just before the fed first recording medium 8 is held by the first conveyance roller 12 and the first driven roller 13 at the downstream position. In this state, the leading portion of the restriction member 26 contacts the first recording medium 8 to be slightly curved upward to restrict the distortion of the first recording medium 8. Consequently, occurrence of uncontrollable bending or distortion in the first recording medium 8 without restriction member 26 can be restricted, and the conveyance can be performed while the first recording medium 8 maintains good curving condition.

FIG. 4D illustrates a state where the first recording medium 8 is conveyed by the first conveyance roller 12. The conveyance of the first recording medium 8 is controlled by the first conveyance roller 12. Consequently, due to the stiffness of the first recording medium 8, the first sheet feeding roller 10 and the restriction members 26 rotate around the supporting member 25, and are slightly moved upward. Especially, the restriction members 26 are elastically deformed upward to reduce the unnecessary load to the conveyance of the first recording medium 8.

The orientation of the recording medium curved at the space between the first stacking portion 6 and the first inclined portion 11 differs depending on the stiffness of the recording medium. The restriction members 26 are configured to be thin and to effectively control occurrence of bending and distortion in a recording medium having low stiffness, and is disposed in the recording medium.

In other words, it is desirable that at the time of the start of sheet feeding operation, the restriction members 26 do not contact the recording medium, and that, after the recording medium is fed, irrespective of the type of the recording medium, in a state where the recording medium contacts the inclined portion and starts curving, the leading portions of the restriction members 26 contact the recording medium.

Alternatively, it may be defined that, to a locus of the recording medium conveyed in a state where the recording medium curves along the inclined portion after the start of the sheet feeding operation, across the locus, the leading portion of the restriction member 26 is to be located at a position closer to the inclined portion.

Further, it is desirable that the restriction members 26 are configured not to be a conveyance load while functioning as a distortion restriction structure to the conveyance of the recording medium. For example, as illustrated in FIGS. 4C and 4D, it is desirable that the restriction member 26 is made of a film-type or sheet-type deformable flexible member.

Further, it is desirable that the state of the contact portion of the restriction member contacting the recording medium is line contact. In the wide line contact state, the restriction of the recording medium can be effectively performed. In point contact, depending on the type of the recording medium, the bending occurring at 108*m* in FIG. 8 may occur, and, in the conveyance by the conveyance roller, the recording medium may wrinkle.

Hereinafter, bent postures of the recording medium 8 in a structure the restriction members 26 are provided to the supporting member 25 is described.

Figure 6:
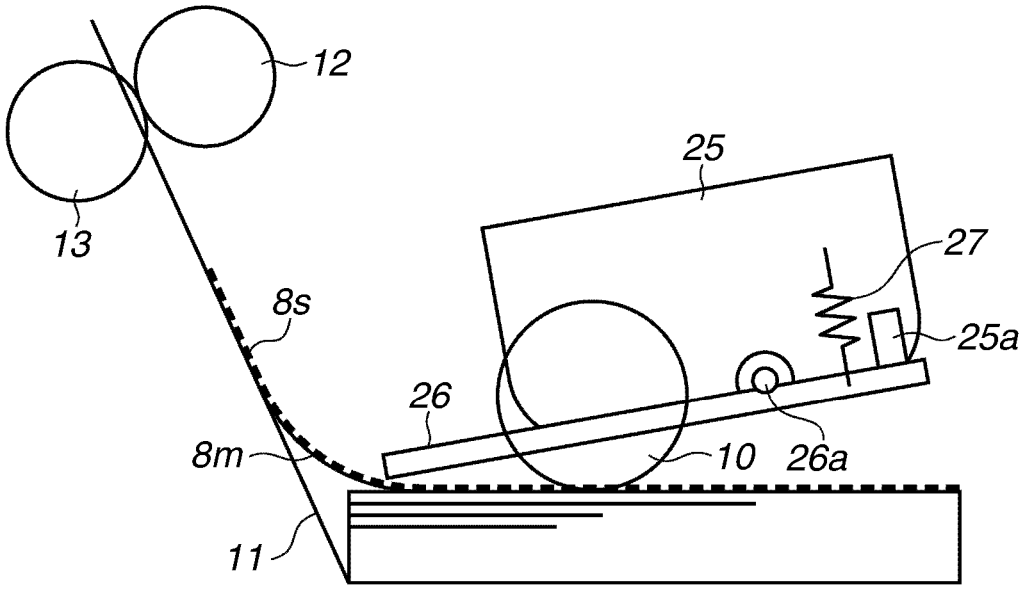
FIG. 6 is a cross-sectional view schematically illustrating main components of a sheet feeding apparatus according to a second exemplary embodiment of the present invention.
Figure 7:
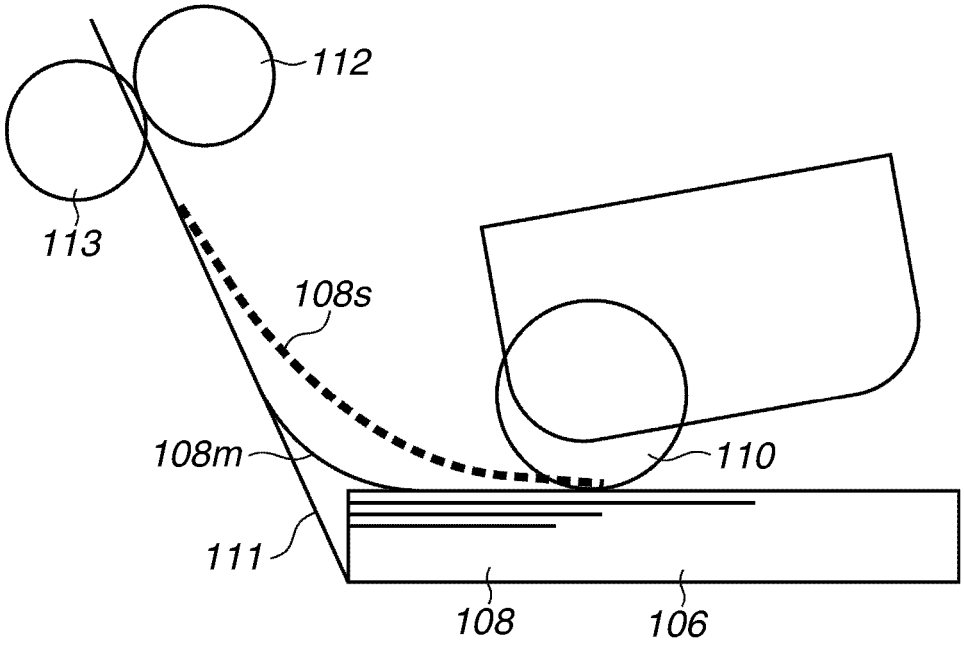
FIG. 7 is a cross-sectional view schematically illustrating a conveyance state of a recording medium by a sheet feeding apparatus using a conveyance roller not provided with a restriction member.

FIG. 6 is a cross-sectional view schematically illustrating an orientation of the recording medium 8 restricted by the restriction member 26. FIG. 7 is a top view illustrating a bent orientation of the recording medium 8 illustrated in FIG. 6, viewed from the direction perpendicular to the recording medium 8.

A pair of the restriction members 26 is, as described above, symmetrically disposed via the sheet feeding roller 10 in the width direction of the recording medium 8. Each of the restriction members 26 extends toward the slope to press the uppermost layer of the first recording medium 8 at a position closer to the slope of the inclined portion 11 than the first sheet feeding roller 10. By the structure, the both end portions of the first recording medium 8 out of the range the pressure of the sheet feeding roller 10 can be applied can be pressed by the restriction members 26. Consequently, as illustrated in FIG. 6, in the recording medium 8, the bent posture (see portion 8*s* in FIG. 6) at the both end portions becomes similar to the bent posture (see portion 8*m* in FIG. 6) in the vicinity of the center portion. In other words, the recording medium 8 has an even bent posture as a whole in the width direction. This prevents the leading edge of the recording medium 8 from being deformed. As a result, when the leading edge of the recording medium 8 is held by the conveyance roller 12, generation of wrinkles can be reduced.

Meanwhile, in a sheet feeding mechanism for feeding the second recording medium, the above-described structure of the restriction members 26 can be employed.

The restriction members may not be included in a case where the recording medium stacked on the sheet feeding mechanism is a thick recording medium such as coated paper. The restriction members are to be provided to a sheet feeding mechanism stacking a recording medium having low stiffness such as plain paper.

A second exemplary embodiment of the present invention is described. Hereinafter, differences from the first exemplary embodiment are mainly described.

FIG. 6 is a cross-sectional view illustrating main components of a sheet feeding apparatus according to the second exemplary embodiment of the present invention. To components similar to those described in the first exemplary embodiment, the same reference numerals are applied, and their detailed descriptions are not repeated.

As illustrated in FIG. 6, the sheet feeding apparatus according to the present exemplary embodiment includes a rotation shaft 26*a*, a stopper 25*a*, and an elastic member 27. To the rotation shaft 26*a*, the restriction members 26 are supported to be movable in the rotational direction of the sheet feeding roller 10. The stopper 25*a* stops the respective restriction members 26 at predetermined positions. The elastic member 27 elastically deforms according to the rotational force of the restriction members 26, and, by the elastic deformation, the respective restriction members 26 are moved to positions contacting the stopper 25*a*.

In the above-described structure of the sheet feeding apparatus according to the present exemplary embodiment, when the leading portions of the restriction members 26 are pushed by a generated force due to bending of the recording medium 8, the restriction members 26 start to rotate around the rotation shaft 26*a*. In such a state, due to the elastic force of the elastic member 27, the restriction members 26 are stopped at the positions contacting the stopper 25*a*. As a result, the recording medium 8 is pressed by the restriction members 26 at a predetermined pressure.

In the present exemplary embodiment, similar to the first exemplary embodiment, when the leading edge of the recording medium 8 starts to move upward along the slope of the first inclined portion 11, the pair of the restriction members 26 presses the both end portions of the recording medium 8. As a result, the recording medium 8 has an even bent posture as a whole in the width direction. This prevents the leading edge of the recording medium 8 from being deformed. As a result, when the leading edge of the recording medium 8 is held by the conveyance roller 12, generation of wrinkles can be reduced.

Further, with the rotation shaft 26*a*, the stopper 25*a*, and the elastic member 27, the restriction members 26 can evenly bend the recording medium irrespective of the stiffness of the recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-194010 filed Sep. 4, 2012, which is hereby incorporated by reference herein in its entirety.

What is claimed is:

1. A sheet feeding mechanism comprising:

a sheet feeding roller configured to feed an uppermost recording medium from stacked recording mediums;

an inclined portion located at a downstream position of the sheet feeding roller in a conveyance direction of the recording medium and having a surface inclined with respect to the conveyance direction; and a pair of restriction members configured not to contact the recording medium before the sheet feeding roller feeds the recording medium and configured to contact the recording medium in a state where the recording medium is fed by the sheet feeding roller and conveyed along the inclined portion, wherein one of the pair of restriction members is disposed on one side of the sheet feeding roller in a crossing direction crossing the conveyance direction and another of the pair of restriction members is disposed on another side of the sheet feeding roller in a crossing direction crossing the conveyance direction.

2. The sheet feeding mechanism according to claim 1, further comprising a supporting member configured to commonly support the sheet feeding roller and the pair of restriction members.

3. The sheet feeding mechanism according to claim 2, wherein the supporting member is displaced according to a stack amount of the recording medium, and a sheet feeding state by the sheet feeding roller and a restricted state by the pair of restriction members are maintained even in the displacement of the supporting member.

4. The sheet feeding mechanism according to claim 1, wherein the pair of the restriction members are one of a film-type and a sheet-type flexible members.

5. The sheet feeding mechanism according to claim 1, further comprising:

a rotation shaft configured to support the pair of the restriction members to be movable in a rotational direction of the sheet feeding roller;

a stopper configured to stop the pair of the restriction members at a predetermined position; and an elastic member configured to move the pair of the restriction members to the predetermined position by elastic deformation according to a rotational force of the pair of the restriction members.

6. A recording apparatus comprising:

the sheet feeding mechanism according to claim 1;

a conveyance path having a conveyance roller configured to convey the recording medium fed by the sheet feeding mechanism to a recording area, and a conveyance guide; and a recording head configured to perform recording in the recording area.

7. The recording apparatus according to claim 6, further comprising, in addition to the sheet feeding mechanism, a second sheet feeding mechanism.

8. A recording apparatus comprising:

a plurality of the sheet feeding mechanisms according to claim 1;

a conveyance path having a conveyance roller configured to convey a recording medium fed by one of the sheet feeding mechanisms to a recording area, and a conveyance guide; and a recording head configured to perform recording in the recording area.

9. The sheet feeding mechanism according to claim 1, wherein the pair of restriction members are disposed above the stacked recording mediums.

10. A sheet feeding mechanism comprising:

a sheet feeding roller configured to feed stacked sheet-type recording mediums one by one from an uppermost recording medium, with an inclined portion; and a pair of restriction members configured not to contact the recording medium before the sheet feeding roller feeds the recording medium, and configured to contact the recording medium in a state where the recording medium is curved and fed along the inclined portion, wherein one of the pair of restriction members is disposed on one side of the sheet feeding roller in a crossing direction crossing the conveyance direction and another of the pair of restriction members is disposed on another side of the sheet feeding roller in a crossing direction crossing the conveyance direction.

11. The sheet feeding mechanism according to claim 10, further comprising a supporting member configured to support the sheet feeding roller and the pair of restriction members, wherein the sheet feeding roller is configured to contact the recording medium and to feed the recording medium.

12. The sheet feeding mechanism according to claim 11, wherein the supporting member is displaced according to a stack amount of the recording medium, and a sheet feeding state by the sheet feeding roller and a restricted state by the pair of the restriction members are maintained even in the displacement of the supporting member.

13. The sheet feeding mechanism according to claim 10, wherein the pair of the restriction members are one of a film-type and a sheet-type flexible members.

14. The sheet feeding mechanism according to claim 10, wherein the pair of restriction members is further configured to contact a curved portion of the recording medium at a downstream position to the sheet feeding roller in a state where the recording medium is curved and fed along the inclined portion.

15. A sheet feeding mechanism comprising:

a sheet feeding roller configured to feed stacked sheet-type recording mediums one by one from an uppermost recording medium, with an inclined portion; and a pair of restriction members configured not to contact the recording medium before the sheet feeding roller feeds the recording medium, and provided so that a leading portion of the pair of the restriction members is to be located, after the sheet feeding roller starts to feed the recording medium, at a position closer to the inclined portion than a position of the sheet feeding roller, and so that the leading portion crosses a locus of the recording medium being conveyed in a state where the recording medium curves along the inclined portion, wherein one of the pair of restriction members is disposed on one side of the sheet feeding roller in a crossing direction crossing the conveyance direction and another of the pair of restriction members is disposed on another side of the sheet feeding roller in a crossing direction crossing the conveyance direction.

16. The sheet feeding mechanism according to claim 15, further comprising a supporting member configured to support the sheet feeding roller and the pair of the restriction members, wherein the sheet feeding roller is configured to contact the recording medium and to feed the recording medium.

17. The sheet feeding mechanism according to claim 16, wherein the supporting member is displaced according to a stack amount of the recording medium, and a sheet feeding state by the sheet feeding roller and a restricted state by the pair of the restriction members are maintained even in the displacement of the supporting member.

18. The sheet feeding mechanism according to claim 16, wherein the pair of the restriction members are one of a film-type and a sheet-type flexible members.

19. A sheet feeding mechanism comprising:

a sheet feeding roller configured to feed stacked sheet-type recording mediums one by one from an uppermost recording medium, with an inclined portion; and a pair of restriction members configured not to contact the recording medium before the sheet feeding roller feeds the recording medium, and configured to contact a recording medium at a downstream position to the sheet feeding roller in a state where the recording medium is fed by the sheet feeding roller and conveyed along the inclined portion, wherein one of the pair of restriction members is disposed on one side of the sheet feeding roller in a crossing direction crossing the conveyance direction and another of the pair of restriction members is disposed on another side of the sheet feeding roller in a crossing direction crossing the conveyance direction.

20. A sheet feeding mechanism comprising:

a sheet feeding roller configured to feed an uppermost recording medium from stacked recording mediums;

an inclined portion located at a downstream position of the sheet feeding roller in a conveyance direction of the recording medium and having a surface inclined with respect to the conveyance direction; and a restriction unit configured not to contact the recording medium before the sheet feeding roller feeds the recording medium, and configured to contact the recording medium in a state where the recording medium is fed by the sheet feeding roller and conveyed along the inclined portion, wherein the restriction unit includes a pair of restriction members one of which is disposed on one side of the sheet feeding roller in a crossing direction crossing the conveyance direction and another of which is disposed on another side of the sheet feeding roller in a crossing direction crossing the conveyance direction.

21. A sheet feeding mechanism comprising:

a sheet feeding roller configured to feed stacked sheet-type recording mediums one by one from an uppermost recording medium, with an inclined portion;

a restriction unit configured not to contact the recording medium before the sheet feeding roller feeds the recording medium, and configured to contact the recording medium in a state where the recording medium is curved and fed along the inclined portion; and a supporting member configured to support the sheet feeding roller and the restriction unit, wherein the sheet feeding roller is configured to contact the recording medium and to feed the recording medium, and wherein the restriction unit includes a pair of restriction members one of which is disposed on one side of the sheet feeding roller in a crossing direction crossing the conveyance direction and another of which is disposed on another side of the sheet feeding roller in a crossing direction crossing the conveyance direction.

22. A sheet feeding mechanism comprising:

a sheet feeding roller configured to feed stacked sheet-type recording mediums one by one from an uppermost recording medium, with an inclined portion;

a restriction unit configured not to contact the recording medium before the sheet feeding roller feeds the recording medium, and provided so that a leading portion of the restriction unit is to be located, after the sheet feeding roller starts to feed the recording medium, at a position closer to the inclined portion by crossing a locus of the recording medium being conveyed in a state where the recording medium curves along the inclined portion; and a supporting member configured to support the sheet feeding roller and the restriction unit, wherein the sheet feeding roller is configured to contact the recording medium and to feed the recording medium, and wherein the restriction unit includes a pair of restriction members one of which is disposed on one side of the sheet feeding roller in a crossing direction crossing the conveyance direction and another of which is disposed on another side of the sheet feeding roller in a crossing direction crossing the conveyance direction.

* * * * *